US010993017B2

(12) United States Patent
Singh et al.

(10) Patent No.: US 10,993,017 B2
(45) Date of Patent: Apr. 27, 2021

(54) SMART EARBUD DEVICE OF AN EARPHONE

(71) Applicants: Ningombam Aryamann Singh, Chandimandir (IN); Hritik Rewaria, Panchkula (IN); Siya Singh, Alpharetta, GA (US); Sanjeev Kumar Singh, Alpharetta, GA (US)

(72) Inventors: Ningombam Aryamann Singh, Chandimandir (IN); Hritik Rewaria, Panchkula (IN); Siya Singh, Alpharetta, GA (US); Sanjeev Kumar Singh, Alpharetta, GA (US)

( * ) Notice: Subject to any disclaimer, the term of this patent is extended or adjusted under 35 U.S.C. 154(b) by 0 days.

(21) Appl. No.: 16/576,722

(22) Filed: Sep. 19, 2019

(65) Prior Publication Data

US 2021/0092507 A1 Mar. 25, 2021

(51) Int. Cl.
*H04R 1/10* (2006.01)
*G08B 21/24* (2006.01)

(52) U.S. Cl.
CPC ..... *H04R 1/1066* (2013.01); *G08B 21/24* (2013.01); *H04R 1/1016* (2013.01)

(58) Field of Classification Search
CPC ..... H04R 1/1041; H04R 1/1025
See application file for complete search history.

(56) References Cited

U.S. PATENT DOCUMENTS

| | | | | |
|---|---|---|---|---|
| 5,418,521 | A * | 5/1995 | Read | G08B 13/1409 200/61.59 |
| 6,674,358 | B1 * | 1/2004 | Tinsley | H04M 1/04 224/245 |
| 8,655,005 | B2 * | 2/2014 | Birger | H04R 1/1091 381/381 |
| 10,390,121 | B2 * | 8/2019 | Kim | H04R 1/1066 |
| 2010/0320961 | A1 * | 12/2010 | Castillo | H02J 7/0044 320/107 |
| 2016/0049069 | A1 * | 2/2016 | Oliveira | G08B 21/0247 340/539.11 |
| 2016/0058206 | A1 * | 3/2016 | Schwalbach | H02J 7/0042 361/752 |
| 2018/0152778 | A1 * | 5/2018 | Du | H04R 1/1025 |
| 2019/0052952 | A1 * | 2/2019 | Freund | H04R 1/105 |
| 2020/0204898 | A1 * | 6/2020 | Schoeck | G06F 3/167 |

* cited by examiner

*Primary Examiner* — Ryan Robinson
(74) *Attorney, Agent, or Firm* — Sanjeev K. Singh

(57) ABSTRACT

A smart earbud device including a first bud and a first base is provided. The smart earbud device comprises a first conductive connection-separation mechanism coupled to the first bud and the first base to indicate a first status of a first connection condition and a first separation condition associated with the first bud and the first base. The smart earbud device further comprises an electronic alarm mechanism configured to sound an alarm signal upon detection of the first separation condition of the first bud and first base. The smart earbud device further comprises an electric wire circuit to connect the first conductive connection-separation mechanism to the electronic alarm mechanism to enable the electronic alarm mechanism to receive the first status of the first separation condition from the first conductive connection-separation mechanism.

17 Claims, 3 Drawing Sheets

SMART EARBUD DEVICE OF AN EARPHONE

BACKGROUND

1. Field

Aspects of the present invention relate to two smart earbuds of an earphone in which for an unintentional/accidental situation first and second metallic rings would be removed/separated from a circuit, causing the circuit to break and ring an alarm.

2. Description of the Related Art

Use of audio earpieces that include an ear bud which is configured to be received in the ear of a user of a personal electronic device is well known. Unintentionally an earbud cup of an earbud may get removed from the earphone and drop or get lost. Without an earbud cup the earbud becomes not very useful and a user may have to discard the whole earphone, incurring cost to buy a new earphone to replace the original one. This is a serious problem as the earbud cup is designed to mount in an earbud head loosely so it can be changed with other size earcups. Loosing just one earbud cup renders the whole earphone useless.

Smart means for keeping an earbud cup of an earbud retained on an earbud head such that they are not inadvertently lost are needed.

SUMMARY

Briefly described, aspects of the present invention relate to two smart earbuds of an earphone in which for an unintentional/accidental situation first and second metallic rings would be removed/separated from a circuit, causing the circuit to break and ring an alarm. Smart means for keeping an earbud cup of an earbud retained on an earbud head are provided such that when they are detached inadvertently they are not lost. This way by avoiding loosing of an earbud cup does not render the whole earphone useless.

In accordance with one illustrative embodiment of the present invention, a smart earbud device including a first bud and a first base is provided. The smart earbud device comprises a first conductive connection-separation mechanism coupled to the first bud and the first base to indicate a first status of a first connection condition and a first separation condition associated with the first bud and the first base. The smart earbud device further comprises an electronic alarm mechanism configured to sound an alarm signal upon detection of the first separation condition of the first bud and first base. The smart earbud device further comprises an electric wire circuit to connect the first conductive connection-separation mechanism to the electronic alarm mechanism to enable the electronic alarm mechanism to receive the first status of the first separation condition from the first conductive connection-separation mechanism.

In accordance with another illustrative embodiment of the present invention, a method of providing a smart earbud device including a first bud and a first base is provided. The method comprises providing a first conductive connection-separation mechanism coupled to the first bud and the first base to indicate a first status of a first connection condition and a first separation condition associated with the first bud and the first base; providing an electronic alarm mechanism configured to sound an alarm signal upon detection of the first separation condition of the first bud and first base; and providing an electric wire circuit to connect the first conductive connection-separation mechanism to the electronic alarm mechanism to enable the electronic alarm mechanism to receive the first status of the first separation condition from the first conductive connection-separation mechanism.

DETAILED DESCRIPTION

To facilitate an understanding of embodiments, principles, and features of the present invention, they are explained hereinafter with reference to implementation in illustrative embodiments. In particular, they are described in the context of a type of indicator having a symbol that displays a charge port pin format, a pointer that points to a physical location of the charge port and a marker that indicates a type of a plug to be used in the charge port for charging the electric vehicle. Embodiments of the present invention, however, are not limited to use in the described devices or methods.

The components and materials described hereinafter as making up the various embodiments are intended to be illustrative and not restrictive. Many suitable components and materials that would perform the same or a similar function as the materials described herein are intended to be embraced within the scope of embodiments of the present invention.

Figure 1:
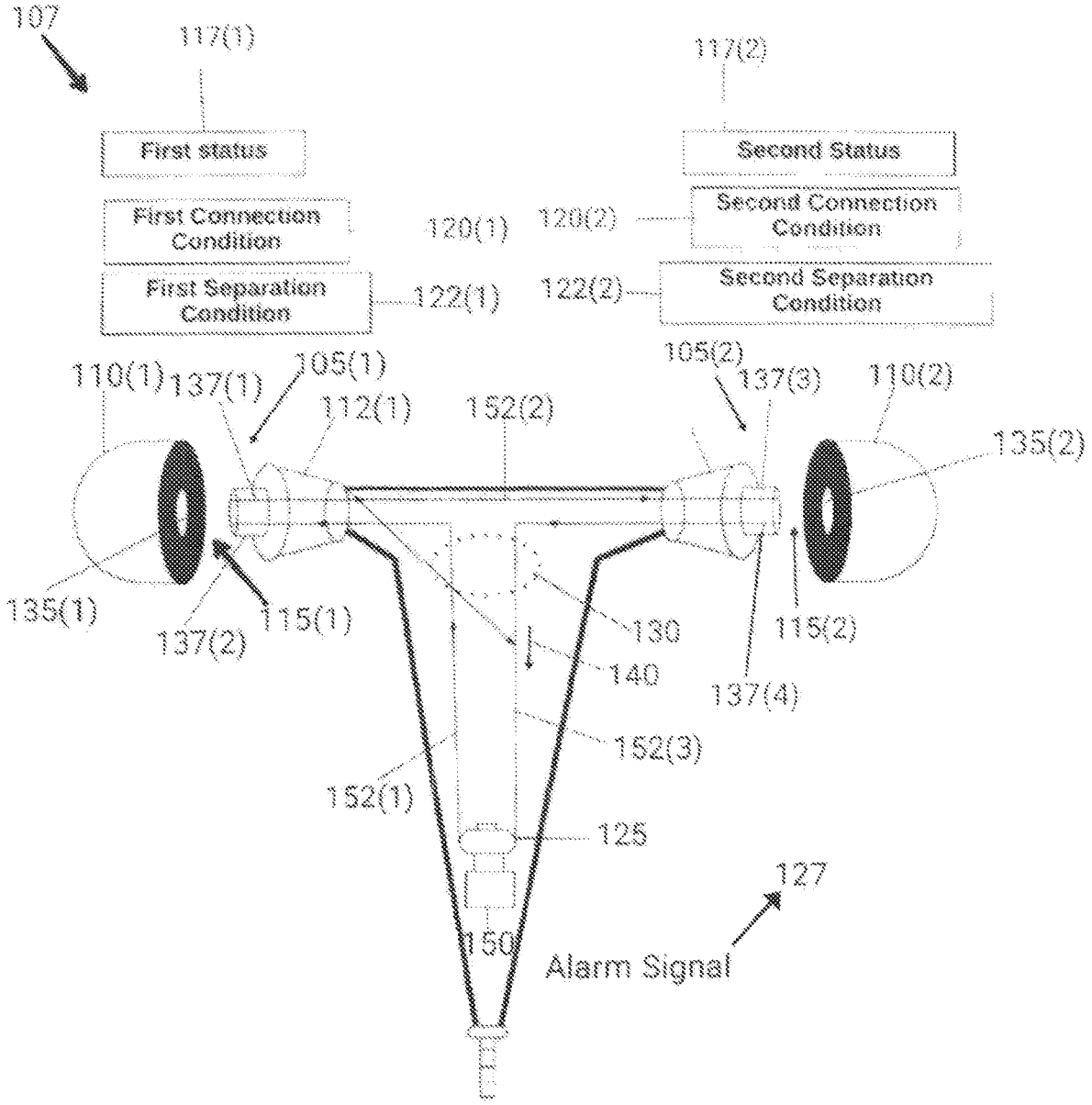
FIG. 1 illustrates a schematic of two smart earbuds of an earphone in accordance with an exemplary embodiment of the present invention.

FIG. 1 illustrates a schematic of two smart earbuds 105(1-2) of an earphone 107 in accordance with an exemplary embodiment of the present invention. A first smart earbud device 105(1) is a smart earbud device including a first bud 110(1) and a first base 112(1). The first smart earbud device 105(1) comprises a first conductive connection-separation mechanism 115(1) coupled to the first bud 110(1) and the first base 112(1) to indicate a first status 117(1) of a first connection condition 120(1) and a first separation condition 122(1) associated with the first bud 110(1) and the first base 112(1). The first smart earbud device 105(1) further comprises an electronic alarm mechanism 125 configured to sound an alarm signal 127 upon detection of the first separation condition 122(1) of the first bud 110(1) and the first base 112(1). The first smart earbud device 105(1) further comprises an electric wire circuit 130 to connect the first conductive connection-separation mechanism 115(1) to the electronic alarm mechanism 125 to enable the electronic alarm mechanism 125 to receive the first status 117(1) of the first separation condition 122(1) from the first conductive connection-separation mechanism 115(1).

The first conductive connection-separation mechanism 115(1) comprises a first metallic ring 135(1) embedded into the first bud 110(1) near an opening to frictionally receive the first base 112(1). The first conductive connection-separation mechanism 115(1) further comprises a first pair of rods 137(1-2) disposed horizontally to provide resilience and coupled to the first base 112(1) such that tip regions of the first pair of rods 137(1-2) electrically connect to the first metallic ring 135(1).

The first metallic ring 135(1) is a thin wire/conductor that is fixed in the first smart earbud device 105(1) to pass a current 140 through it and complete the circuit 130. When the earbuds are removed, breaking of the circuit takes place and alarm rings.

A second smart earbud device 105(2) comprises a second bud 110(2), a second base 112(2) and a second conductive connection-separation mechanism 115(2) coupled to the second bud 110(2) and the second base 112(2) to indicate a second status 117(2) of a second connection condition 120(2) and a second separation condition 122(2) associated with the second bud 110(2) and the second base 112(2). The second conductive connection-separation mechanism 115(2) comprises a second metallic ring 135(2) embedded into the second bud 110(2) near an opening to frictionally receive the second base 112(2). The second conductive connection-separation mechanism 115(2) further comprises a second pair of rods 137(3-4) disposed horizontally to provide resilience and coupled to the second base 112(2) such that tip regions of the second pair of rods 137(3-4) electrically connect to the second metallic ring 135(2).

In the first smart earbud device 105(1), the electronic alarm mechanism 125 comprises a toggle switch (not shown) to turn OFF an alarm system so that the electronic alarm mechanism 125 does not sound the alarm signal 127 and to turn ON the alarm system so that the electronic alarm mechanism 125 sounds the alarm signal 127. The electronic alarm mechanism 125 comprises a cell battery 150 to power the alarm system.

In the first smart earbud device 105(1), the electric wire circuit 130 comprises a first wire 152(1), a second wire 152(2) and a third wire 152(3). The first wire 152(1) is configured to send the current 140 from an alarm system of the electronic alarm mechanism 125 to the first metallic ring 135(1) embedded into the first bud 110(1) near an opening. The second wire 152(2) is configured to send the current 140 from the first metallic ring 135(1) embedded into the first bud 110(1) near an opening to the second metallic ring 135(2) embedded into the second bud 110(2) near an opening. The third wire 152(3) is configured to send the current 140 from the second metallic ring 135(2) embedded into the second bud 110(2) near the opening to the alarm system of the electronic alarm mechanism 125.

The second wire 152(2) is used to make the whole circuit 130 a series circuit. In this way, even if one of the smart earbuds 105(1-2) is removed, the whole circuit 130 breaks and the alarm signal 127 rings.

Current travels from the alarm system (consisting of a battery and an alarm) to the first wire 152(1). Ends of the first wire 152(1) touch the first metallic ring 135(1) for conduction. The first metallic ring 135(1) is attached to the first base 112(1) for completing the circuit 130. Current then travels from the first metallic ring 135(1) to the second wire 152(2) (the second wire 152(2) is used to send the current 140 to both the smart earbuds 105(1-2)). This makes the whole circuit 130 a series circuit. Ends of the second wire 152(2) touch the second metallic ring 135(2) for conduction. (the second metallic ring 135(2) is attached to the second base 112(2) for completing the circuit 130). Current then travels from the second metallic ring 135(2) to the third wire 152(3). This sends the current 140 back to the alarm system and completes the circuit 130.

If, for any reason (intentional/unintentional) the first bud 110(1) is removed from the first base 112(1), then the following would happen:

INTENTIONAL: If the removal of the first bud 110(1) is intentional, for example: for exchanging the first bud 110(1), then the user can simply switch off the whole circuit 130 by using the on/off switch in the alarm system and switch it on later if they want to.

UNINTENTIONAL/ACCIDENTAL: If the removal of the first or second buds 110(1, 2) is unintentional/accidental, then the first and the second metallic rings 135(1-2) would be removed/separated from the circuit 130, causing the circuit 130 to break and the and the alarm signal 127 rings.

Magnetic effect caused due to the wires 152(1-3) should not affect the overall working of the earphone 107 as its magnitude would be very less. The first and the second metallic rings 135(1-2) are to be connected in an inner circle for easy insertion and removal of the earbuds 105(1-2) and for the completion of circuit 130. Markings would be made in the first or second buds 110(1, 2) so that a user can insert the first or second buds 110(1, 2) in a way that the circuit 130 gets completed. Markings would also be made on the earphone 107.

Figure 2:
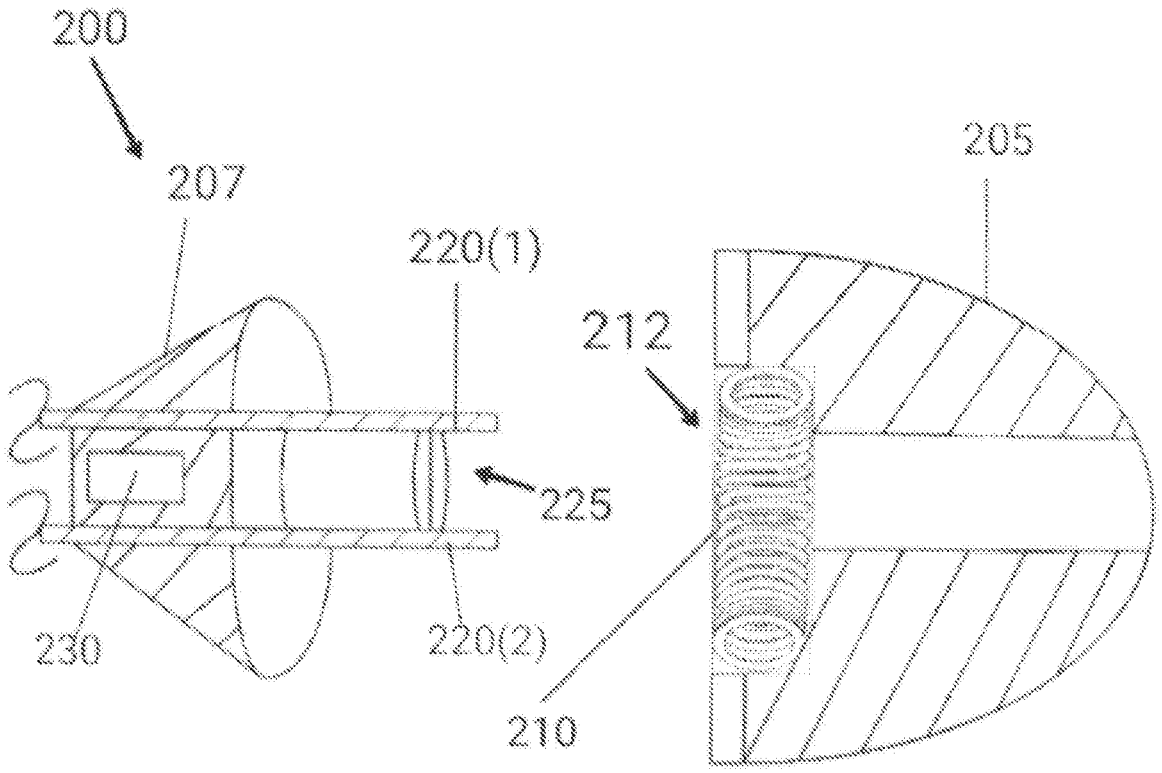
FIG. 2 illustrates a cross-sectional view of a smart earbud of an earphone in accordance with an exemplary embodiment of the present invention.

FIG. 2 illustrates a cross-sectional view of a smart earbud device 200 of an earphone in accordance with an exemplary embodiment of the present invention. Smart means are provided for keeping an earbud cup 205 of the smart earbud device 200 retained on an earbud head 207 such that it is not inadvertently lost.

The earbud cup 205 comprises a metallic ring in a form of a round spring 210 embedded in a body of the earbud cup 205 such that an inner side 212 of the round spring 210 is exposed to electrically contact with another metal or conductive component. The earbud cup 205 further comprises a hollow channel 215 for sound to reach an ear of a user.

The earbud head 207 comprises a first wire tip 220(1) and a second wire tip 220(2) to electrically contact the round spring 210. The first wire tip 220(1) and the second wire tip 220(2) embedded in a body of the earbud head 207 such that they complete a connection of the circuit 130. The first wire tip 220(1) and the second wire tip 220(2) may be shaped as half cylindrical. The first wire tip 220(1) and the second wire tip 220(2) are separated by one another with a gap 225. The first wire tip 220(1) and the second wire tip 220(2) are connected to the wires 152(1-3) depending upon if the smart earbud 200 is a left earbud or a right earbud of the earphone 107. The earbud head 207 comprises a speaker and/or a microphone 230.

Figure 3:
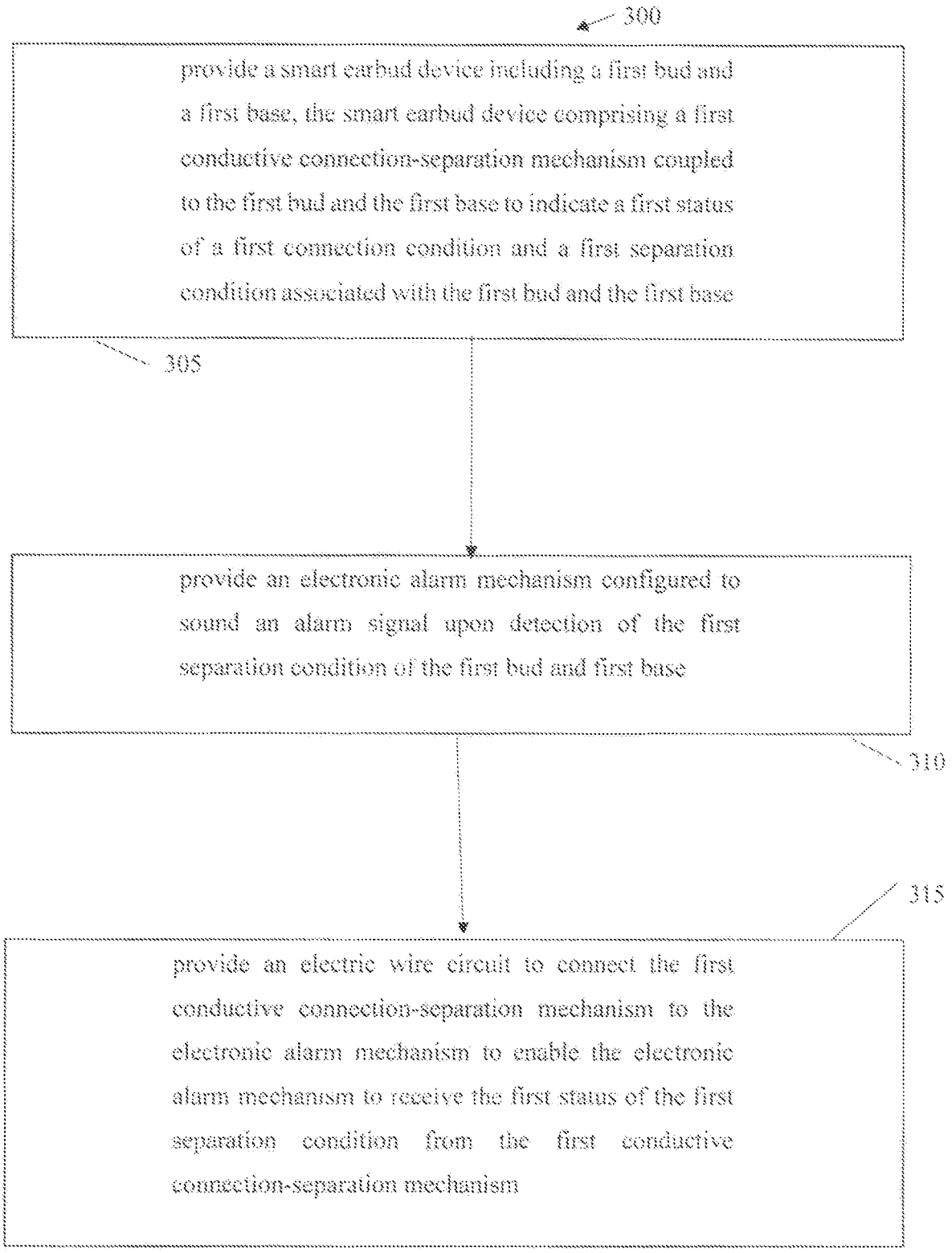
FIG. 3 illustrates a flow chart of a method of providing a smart earbud device in accordance with an exemplary embodiment of the present invention.

FIG. 3 illustrates a flow chart of a method 300 of providing the smart earbud device 200 in accordance with an exemplary embodiment of the present invention. Reference is made to the elements and features described in FIGS. 1-2. It should be appreciated that some steps are not required to be performed in any particular order, and that some steps are optional.

The method 300 comprises a step 305 of providing a smart earbud device including a first bud and a first base wherein the smart earbud device 200 comprises a first conductive connection-separation mechanism coupled to the first bud and the first base to indicate a first status of a first connection condition and a first separation condition associated with the first bud and the first base. The method 300 comprises a step 310 of providing an electronic alarm mechanism configured to sound an alarm signal upon detection of the first separation condition of the first bud and first base. The method 300 comprises a step 315 of providing an electric wire circuit to connect the first conductive connection-separation mechanism to the electronic alarm mechanism to enable the electronic alarm mechanism to receive the first status of the first separation condition from the first conductive connection-separation mechanism. The method 300 further comprises providing a second bud, providing a second base and providing a second conductive connection-separation mechanism coupled to the second bud and the second base to indicate a second status of a second connection condition and a second separation condition associated with the second bud and the second base.

While embodiments of the present invention have been disclosed in exemplary forms, it will be apparent to those skilled in the art that many modifications, additions, and deletions can be made therein without departing from the spirit and scope of the invention and its equivalents, as set forth in the following claims.

Embodiments and the various features and advantageous details thereof are explained more fully with reference to the non-limiting embodiments that are illustrated in the accompanying drawings and detailed in the following description. Descriptions of well-known starting materials, processing techniques, components and equipment are omitted so as not to unnecessarily obscure embodiments in detail. It should be understood, however, that the detailed description and the specific examples, while indicating preferred embodiments, are given by way of illustration only and not by way of limitation. Various substitutions, modifications, additions and/or rearrangements within the spirit and/or scope of the underlying inventive concept will become apparent to those skilled in the art from this disclosure.

As used herein, the terms "comprises," "comprising," "includes," "including," "has," "having" or any other variation thereof, are intended to cover a non-exclusive inclusion. For example, a process, article, or apparatus that comprises a list of elements is not necessarily limited to only those elements but may include other elements not expressly listed or inherent to such process, article, or apparatus.

Additionally, any examples or illustrations given herein are not to be regarded in any way as restrictions on, limits to, or express definitions of, any term or terms with which they are utilized. Instead, these examples or illustrations are to be regarded as being described with respect to one particular embodiment and as illustrative only. Those of ordinary skill in the art will appreciate that any term or terms with which these examples or illustrations are utilized will encompass other embodiments which may or may not be given therewith or elsewhere in the specification and all such embodiments are intended to be included within the scope of that term or terms.

In the foregoing specification, the invention has been described with reference to specific embodiments. However, one of ordinary skill in the art appreciates that various modifications and changes can be made without departing from the scope of the invention. Accordingly, the specification and figures are to be regarded in an illustrative rather than a restrictive sense, and all such modifications are intended to be included within the scope of invention.

Although the invention has been described with respect to specific embodiments thereof, these embodiments are merely illustrative, and not restrictive of the invention. The description herein of illustrated embodiments of the invention is not intended to be exhaustive or to limit the invention to the precise forms disclosed herein (and in particular, the inclusion of any particular embodiment, feature or function is not intended to limit the scope of the invention to such embodiment, feature or function). Rather, the description is intended to describe illustrative embodiments, features and functions in order to provide a person of ordinary skill in the art context to understand the invention without limiting the invention to any particularly described embodiment, feature or function. While specific embodiments of, and examples for, the invention are described herein for illustrative purposes only, various equivalent modifications are possible within the spirit and scope of the invention, as those skilled in the relevant art will recognize and appreciate. As indicated, these modifications may be made to the invention in light of the foregoing description of illustrated embodiments of the invention and are to be included within the spirit and scope of the invention. Thus, while the invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the invention.

Respective appearances of the phrases "in one embodiment," "in an embodiment," or "in a specific embodiment" or similar terminology in various places throughout this specification are not necessarily referring to the same embodiment. Furthermore, the particular features, structures, or characteristics of any particular embodiment may be combined in any suitable manner with one or more other embodiments. It is to be understood that other variations and modifications of the embodiments described and illustrated herein are possible in light of the teachings herein and are to be considered as part of the spirit and scope of the invention.

In the description herein, numerous specific details are provided, such as examples of components and/or methods, to provide a thorough understanding of embodiments of the invention. One skilled in the relevant art will recognize, however, that an embodiment may be able to be practiced without one or more of the specific details, or with other apparatus, systems, assemblies, methods, components, materials, parts, and/or the like. In other instances, well-known structures, components, systems, materials, or operations are not specifically shown or described in detail to avoid obscuring aspects of embodiments of the invention. While the invention may be illustrated by using a particular embodiment, this is not and does not limit the invention to any particular embodiment and a person of ordinary skill in the art will recognize that additional embodiments are readily understandable and are a part of this invention.

Although the steps, operations, or computations may be presented in a specific order, this order may be changed in different embodiments. In some embodiments, to the extent multiple steps are shown as sequential in this specification, some combination of such steps in alternative embodiments may be performed at the same time.

Embodiments described herein can be implemented in the form of control logic in software or hardware or a combination of both. The control logic may be stored in an information storage medium, such as a computer-readable medium, as a plurality of instructions adapted to direct an information processing device to perform a set of steps disclosed in the various embodiments. Based on the disclosure and teachings provided herein, a person of ordinary skill in the art will appreciate other ways and/or methods to implement the invention.

It will also be appreciated that one or more of the elements depicted in the drawings/figures can also be implemented in a more separated or integrated manner, or even removed or rendered as inoperable in certain cases, as is useful in accordance with a particular application.

Benefits, other advantages, and solutions to problems have been described above with regard to specific embodiments. However, the benefits, advantages, solutions to problems, and any component(s) that may cause any benefit, advantage, or solution to occur or become more pronounced are not to be construed as a critical, required, or essential feature or component.

What is claimed is:

1. A smart earbud device including a first bud and a first base, comprising:

a first conductive connection-separation mechanism coupled to the first bud and the first base to indicate a first status of a first connection condition and a first separation condition associated with the first bud and the first base;

an electronic alarm mechanism configured to sound an alarm signal upon detection of the first separation condition of the first bud and first base; and an electric wire circuit to connect the first conductive connection-separation mechanism to the electronic alarm mechanism to enable the electronic alarm mechanism to receive the first status of the first separation condition from the first conductive connection-separation mechanism, wherein the first conductive connection-separation mechanism comprises:

a first metallic ring embedded into the first bud near an opening to frictionally receive the first base; and a first pair of rods disposed horizontally to provide resilience and coupled to the first base such that tip regions of the first pair of rods electrically connect to the first metallic ring.

2. The smart earbud device of claim 1, further comprising:

a second bud;

a second base; and a second conductive connection-separation mechanism coupled to the second bud and the second base to indicate a second status of a second connection condition and a second separation condition associated with the second bud and the second base.

3. The smart earbud device of claim 2, wherein the second conductive connection-separation mechanism comprises:

a second metallic ring embedded into the second bud near an opening to frictionally receive the second base; and a second pair of rods disposed horizontally to provide resilience and coupled to the second base such that tip regions of the second pair of rods electrically connect to the second metallic ring.

4. The smart earbud device of claim 1, wherein the electronic alarm mechanism comprises:

a toggle switch to turn OFF an alarm system so that the electronic alarm mechanism does not sound the alarm signal and to turn ON the alarm system so that the electronic alarm mechanism sounds the alarm signal.

5. The smart earbud device of claim 4, wherein the electronic alarm mechanism comprises:

a cell battery to power the alarm system.

6. The smart earbud device of claim 1, wherein the electric wire circuit comprises:

a first wire;

a second wire; and a third wire.

7. The smart earbud device of claim 6, wherein the first wire is configured to send current from an alarm system of the electronic alarm mechanism to a first metallic ring embedded into the first bud near an opening.

8. The smart earbud device of claim 7, wherein the second wire is configured to send current from a first metallic ring embedded into the first bud near an opening to a second metallic ring embedded into the second bud near an opening.

9. The smart earbud device of claim 8, wherein the third wire is configured to send current from the second metallic ring embedded into the second bud near the opening to the alarm system of the electronic alarm mechanism.

10. A method of providing a smart earbud device including a first bud and a first base, the method comprising:

providing a first conductive connection-separation mechanism coupled to the first bud and the first base to indicate a first status of a first connection condition and a first separation condition associated with the first bud and the first base;

providing an electronic alarm mechanism configured to sound an alarm signal upon detection of the first separation condition of the first bud and first base; and providing an electric wire circuit to connect the first conductive connection-separation mechanism to the electronic alarm mechanism to enable the electronic alarm mechanism to receive the first status of the first separation condition from the first conductive connection-separation mechanism, wherein the first conductive connection-separation mechanism comprises:

a first metallic ring embedded into the first bud near an opening to frictionally receive the first base, and a first pair of rods disposed horizontally to provide resilience and coupled to the first base such that tip regions of the first pair of rods electrically connect to the first metallic ring.

11. The method of claim 10, further comprising:

providing a second bud;

providing a second base; and providing a second conductive connection-separation mechanism coupled to the second bud and the second base to indicate a second status of a second connection condition and a second separation condition associated with the second bud and the second base.

12. The method of claim 11, wherein the second conductive connection-separation mechanism comprises:

a second metallic ring embedded into the second bud near an opening to frictionally receive the second base; and a second pair of rods disposed horizontally to provide resilience and coupled to the second base such that tip regions of the second pair of rods electrically connect to the second metallic ring.

13. The method of claim 10, wherein the electronic alarm mechanism comprises:

a toggle switch to turn OFF an alarm system so that the electronic alarm mechanism does not sound the alarm signal and to turn ON the alarm system so that the electronic alarm mechanism sounds the alarm signal.

14. The method of claim 13, wherein the electronic alarm mechanism comprises:

a cell battery to power the alarm system.

15. The method of claim 10, wherein the electric wire circuit comprises:

a first wire;

a second wire; and a third wire, wherein the first wire is configured to send current from an alarm system of the electronic alarm mechanism to a first metallic ring embedded into the first bud near an opening, wherein the second wire is configured to send current from a first metallic ring embedded into the first bud near an opening to a second metallic ring embedded into the second bud near an opening, and wherein the third wire is configured to send current from the second metallic ring embedded into the second bud near the opening to the alarm system of the electronic alarm mechanism.

16. An earphone, comprising:

a first smart earbud device; and a second smart earbud device, wherein the first smart earbud device comprises:

an earbud cup;

an earbud head, wherein the earbud cup is configured to be retained on the earbud head; and means for keeping the earbud cup retained on the earbud head such that release of the earbud cup from the earbud head is electronically detected, wherein the earbud cup further comprises:

a metallic ring in a form of a round spring, the round spring is embedded in a body of the earbud cup such that an inner side of the round spring is exposed to electrically contact with another metal or conductive component, and a hollow channel for sound to reach an ear of a user.

17. The earphone of claim 16, wherein the earbud head further comprises:

a first wire tip and a second wire tip to electrically contact the round spring.

* * * * *